US005701077A

United States Patent [19]

Inagaki

[11] Patent Number: 5,701,077

[45] Date of Patent: Dec. 23, 1997

[54] MISFIRE DETECTING DEVICE FOR GASOLINE INTERNAL COMBUSTION ENGINE

[75] Inventor: Hiroshi Inagaki, Nagoya, Japan

[73] Assignee: NGK Spark Plug Co., Ltd., Nagoya, Japan

[21] Appl. No.: 555,446

[22] Filed: Nov. 9, 1995

[30] Foreign Application Priority Data

Nov. 9, 1994 [JP] Japan ..... 6-275365
Apr. 25, 1995 [JP] Japan ..... 7-101279

[51] Int. Cl.[6] ..... F02P 17/00

[52] U.S. Cl. ..... 324/399; 324/388; 123/630; 123/656

[58] Field of Search ..... 324/378, 388, 324/391, 392, 393, 399, 402; 73/116, 117.2, 117.3, 35.01, 35.08; 123/650, 655, 656, 644, 630

[56] References Cited

U.S. PATENT DOCUMENTS 4,004,561 1/1977 Thieme ..... 123/598
5,503,132 4/1996 Miyata et al. ..... 123/630
5,581,188 12/1996 Miyata et al. ..... 324/388
5,592,926 1/1997 Miyata et al. ..... 123/630
5,617,032 4/1997 Inagaki ..... 324/399

*Primary Examiner*—Ernest F. Karlsen
*Assistant Examiner*—Diep Do
*Attorney, Agent, or Firm*—Foley & Lardner

[57] ABSTRACT

A method of detecting a misfire of a gasoline internal combustion engine is provided. By this method, a high voltage pulse which is not so high as to cause spark discharge, is applied to a secondary winding side of an ignition coil by way of a diode during the time after completion of spark discharge and before generation of a high voltage for next ignition, a misfire at each cylinder is detected on the basis of a decay characteristic of a voltage at a cathode side of the diode, and a charge accumulated at the secondary winding side of the ignition coil is forcedly discharged before a next high voltage pulse is supplied to the secondary winding side. A device for carrying out the above method is also provided.

13 Claims, 12 Drawing Sheets

MISFIRE DETECTING DEVICE FOR GASOLINE INTERNAL COMBUSTION ENGINE

BACKGROUND OF THE INVENTION

1. Field of the Invention

The present invention relates to a misfire detecting device for a gasoline internal combustion engine.

2. Description of the Prior Art

A prior art single-ended distributorless ignition system is shown by way of example in FIG. 9. The ignition system is of the type for use in a two-cylinder internal combustion engine and has ignition coils 920 and 921, power transistors 924 and 925 for allowing battery current to flow intermittently through the primary windings 922 and 923 of the ignition coils 920 and 921, an engine control unit (ECU) 926 for delivering an ignition signal to the power transistors 924 and 925, and spark plugs 927 and 928.

In recent years, there has been an increasing demand for detection of a misfire of an internal combustion engine.

SUMMARY OF THE PRESENT INVENTION

According to an aspect of the present invention, there is provided a method of detecting a misfire of an ignition system for making primary current flow intermittently through a primary winding of an ignition coil for thereby producing a high voltage for ignition in a secondary winding, and supplying the high voltage for ignition produced in the secondary winding to spark plugs provided to respective cylinders of a multi-cylinder internal combustion engine. The method comprises the steps of applying a high voltage pulse which is not so high as to cause spark discharge, to the secondary winding side by way of a diode during the time after completion of spark discharge and before generation of a high voltage for next ignition, detecting a misfire at each cylinder on the basis of a decay characteristic of a voltage at a cathode side of the diode, and discharging a charge accumulated at the secondary winding side of the ignition coil before a next high voltage pulse is supplied to the secondary winding side. When primary current flows through the primary winding intermittently, a high voltage for ignition is produced in the secondary winding. The high voltage for ignition produced in the secondary winding is supplied to each spark plugs by way of high tension codes (in case of a distributor type ignition system, also through a distributor). During the time after spark discharge is completed and before a high voltage for next ignition is induced in the secondary winding of the ignition coil, a high voltage pulse which is not so high as to cause spark discharge is applied to the secondary winding side by way of a diode. In the case where normal combustion takes place in a cylinder, ion current flows across the center electrode and the outer electrode of the spark plug provided to the cylinder. Thus, when the high voltage pulse is applied, the charge due to the high voltage pulse is discharged as ion current, and the voltage produced at the cathode side of the diode drops in a short time such that the normal combustion can be detected. In the case where a misfire due to combustion failure occurs in a certain cylinder, ion current does not flow across the center electrode and the outer electrode of the spark plug. As a result, when the high voltage pulse is applied, the resulting charge is hard to discharge so that the voltage produced at the cathode side of the diode drops gradually to enable detection of the misfire. On the other hand, in the case where a misfire due to discharge failure occurs, the charge due to the high voltage for ignition is accumulated in the floating capacity. However, the accumulated charge is discharged by the discharge means before application of the high voltage pulse. When the high voltage pulse for detection of a misfire is applied, the resulting charge is hard to discharge so that the voltage at the cathode side of the diode drops gradually to enable detection of the misfire. In the meantime, though the charge is accumulated again at the time of next ignition, the accumulated charge is discharged before a next high voltage pulse is supplied. The above method is advantageous since the charge accumulated at the secondary winding side of the ignition coil as a result of a misfire due to discharge failure is discharged before application of the next high voltage pulse, whereby it becomes possible to apply a high voltage pulse for detection of a misfire and observe the decay characteristic of the voltage produced at the cathode side of the diode each time, and a misfire other than the misfire due to combustion failure (such as a misfire due to discharge failure, i.e., a misfire due to the fact that the spark plug does not fire or discharge) can be detected assuredly. In the meantime, this method does not require that a circuit or diode for producing a high voltage pulse be provided to each cylinder, so considerable increase in cost is not incurred and the space for arrangement is not increased considerably.

According to another aspect of the present invention, there is provided a misfire detecting device for a single-ended distributorless ignition system having ignition coils of the same number as cylinders of an engine and each having a primary winding and a secondary winding independent from the primary winding, primary current supplying means for supplying battery current to the primary windings of the ignition coils intermittently and in turn, and spark plugs provided to the respective cylinders of the engine and each connected at a center electrode side to one end of the secondary winding and at an outer electrode side to a cylinder side for grounding. The misfire detecting device comprises pulse generating means for generating a high voltage pulse which is not so high as to cause spark discharge during the time after completion of spark discharge of one of the spark plugs and before application of a high voltage for ignition to another of the spark plugs which is to discharge next, reverse current preventing diodes each for applying the high voltage pulse to another end of the secondary winding, voltage dividing means for dividing a voltage at the other end of the secondary winding to obtain a divided voltage thereat, detecting means for detecting a misfire on the basis of a decay characteristic of the divided voltage after application of the high voltage pulse, and discharge means for discharging a charge accumulated in the secondary winding of each of the ignition coils before the pulse generating means generates a next high voltage pulse. When the primary current supplying means makes buttery current flow through the ignition coils intermittently and in turn, a high voltage for ignition is induced in the secondary windings in turn. The spark plugs thus perform spark discharge in turn. The pulse generating means outputs a high voltage pulse which is not so high as to cause spark discharge during the time after completion of spark discharge of one of the spark plugs and before application of a high voltage for ignition to another one of spark plugs which is to discharge next. The high voltage pulse is applied to the other end of each of the ignition coils by way of the reverse current preventing diode and then applied from one end of the secondary winding to the center electrode of each of the spark plugs. The voltage dividing means divides the voltage at the cathode side of the diode so that the voltage at the cathode side of the diode is within an allowable input range of the misfire detecting means. In the case where normal combustion takes place within a cylinder, ion current flows across the center electrode and the outer electrode of the spark plug provided to the cylinder. For this reason, when the high voltage pulse is applied, the charge caused by the high voltage pulse is discharged as ion current so that the voltage at the cathode side of the diode drops in a short time to enable detection of the normal combustion. In the case where a misfire due to combustion failure occurs in a certain cylinder, ion current does not flow across the center electrode and the outer electrode of the spark plug provided to the cylinder. For this reason, when the high voltage pulse is applied, the charge caused by the high voltage pulse is hard to discharge so that the voltage at the cathode side of the diode drops gradually to enable detection of the misfire. In the meantime, the remaining charge as a result of application of the high voltage pulse is discharged all at the time of next spark discharge of the spark plug provided to the cylinder. On the other hand, in the case where a misfire due to discharge failure occurs, a high voltage for ignition is accumulated at the secondary winding side. However, the accumulated charge is discharged by the discharge means before the pulse generating means outputs a high voltage pulse. Thus, when the high voltage pulse is applied, the voltage at the cathode side of the diode drops gradually (since the charge is hard to be relieved) to enable detection of the misfire. In the meantime, though the charge due to the high voltage for ignition is accumulated again at the secondary winding side at the time of next ignition, the accumulated charge is discharged by the discharge means before the high voltage pulse is supplied from the pulse generating means. The single-ended distributorless ignition system having incorporated therein the misfire detecting means is constructed such that the charge accumulated at the secondary winding side of the ignition coil (such accumulation of charge occurs when a misfire due to discharge failure occurs) is discharged by the discharge means before application of the high voltage pulse. For this reason, when the pulse generating means applies a high voltage pulse to the other end of the secondary winding by way of the diode, the misfire detecting means can detect the decay characteristic of the voltage at the cathode side of the diode correctly each time and therefore a misfire other than a misfire due to combustion failure (i.e., a misfire due to discharge failure, which is caused by the fact that the spark plug does not fire or discharge) can also be detected assuredly. In the meantime, since it is not necessary to provide the pulse generating means, voltage dividing means and diodes to each cylinders, considerable increase in cost is not incurred and a space for arrangement does not increase considerably.

According to a further aspect of the present invention, there is provided a misfire detecting device for a double-ended distributorless ignition system having a plurality of ignition coils for simultaneous spark, primary current supplying means for supplying battery current to primary windings of the ignition coils intermittently and in turn, and positive ignition spark plugs connected at center electrodes to positive pole sides of respective secondary windings of the ignition coils and grounded at outer electrodes, negative ignition spark plugs connected at center electrodes to negative pole sides of the respective secondary windings and grounded at outer electrodes. The misfire detecting device comprises pulse generating means for generating a positive polarity pulse which is not so high as to cause spark discharge, during the time after completion of spark discharge of one of the spark plugs and before application of a high voltage for ignition to another of the spark plugs which is to discharge next, first diodes connected at anodes to an output end of the pulse generating means, second diodes connected at anodes to the cathodes of the respective first diodes and at cathodes to positive pole sides of the respective secondary windings, voltage dividing means for dividing voltages at connecting lines connecting between the cathodes of the first diodes and the anodes of the second diodes to obtain divided voltages thereat, detecting means for detecting a misfire on the basis of decay characteristics of the divided voltages after application of the high voltage pulse, and discharge means for discharging a charge accumulated in each of the connecting lines before the pulse generating means generates a next high voltage pulse. When the primary current supplying means makes primary current flow through the primary windings of the ignition coils for the spark plugs for simultaneous ignition intermittently and in turn, a high voltage pulse is induced in the secondary windings in turn. A pair of spark plugs connected to the same ignition coil are caused to discharge by application of a high voltage. The pulse generating means outputs a high voltage pulse which is not so high as to cause spark discharge after completion of spark discharge of the pair of spark plugs and before beginning of spark discharge of a pair of spark plugs which are to discharge next. The high voltage pulse is transmitted to the positive pole side of the secondary winding of each of the ignition coils by way of the first diode and the second diode and then applied directly or by way of the secondary winding to the center electrode of each of the spark plugs. The voltage dividing means divides the voltage at the connecting line so that the voltage at the connecting line is included within an allowable input range of the misfire detecting means. In the case where normal combustion takes place within a cylinder, ion current flows across the center electrode and the outer electrode of the spark plug provided to the cylinder. Thus, when the high voltage pulse is applied, the resulting charge is discharged as ion current so that the voltage at the connecting line drops in a short time to enable detection of the normal combustion. In the case where a misfire due to discharge failure occurs, the charge caused by the high voltage pulse and the high voltage for ignition is accumulated in the connecting line. However, the accumulated charge is discharged by the discharge means before the pulse generating means generates a next high voltage pulse. Thus, when the high voltage pulse is applied, the voltage at the cathode side of the diode drops gradually (since the charge is hard to be relieved) to enable detection of the misfire. In the meantime, the charge due to the high voltage for ignition is accumulated again in the connecting line at the time of next ignition, the accumulated charge is discharged by the discharge means before the high voltage pulse is supplied from the pulse generating means. The double-ended distributorless ignition system having incorporated therein a misfire detecting device is constructed such that the discharge means discharges the charge accumulated in the connecting line (such accumulation of charge occurs when a misfire due to discharge failure occurs) before the high voltage pulse is outputted. For this reason, when the pulse generating means outputs the high voltage pulse, the decay characteristic of the voltage (i.e., the voltage drops gradually at this time) at the connecting line can be detected correctly each time, and thus a misfire other than a misfire due to combustion failure, i.e., a misfire due to discharge failure, that is caused by the fact that the spark plug does not fire or discharge, can be judged assuredly. In the meantime, it is not necessary to provide the pulse generating means, voltage dividing means, and diodes to each cylinders, considerable increase in cost is not incurred and a space for arrangement is not increased considerably.

According to a further aspect of the present invention, there is provided a misfire detecting device for an ignition having an ignition coil having a primary winding and a secondary winding, primary current supplying means for intermittently supplying battery current to the primary winding of the ignition coil, a distributor connected at a rotor side to one end of the secondary winding, and a spark plug for each cylinder, connected at a center electrode to a side electrode of the distributor by way of a high tension code and grounded at an outer electrode side to a cylinder side. The misfire detecting device comprises pulse generating means for generating a high voltage pulse which is not so high as to cause spark discharge just after completion of the discharge of the spark plug, a first diode connected at an anode to an output end of the pulse generating means, a second diode connected at an anode to a cathode of the first diode and at a cathode to the high tension code, voltage dividing means for dividing a voltage at a connecting line connecting between the cathode of the first diode and the anode of the second diode to obtain a divided voltage thereat, detecting means for detecting a misfire on the basis of a decay characteristic of the divided voltage after application of the high voltage pulse, and discharge means for discharging a charge accumulated in the connecting line before the pulse generating means generates a next high voltage pulse. When the primary current makes battery current flow through the primary winding of the ignition coil intermittently and in turn, a high voltage for ignition is induced in the secondary winding. The high voltage for ignition is applied from the rotor side and through the side electrode to the spark plug provided to the cylinder at the firing cycle, and the spark plug is caused to discharge. The pulse generating means outputs a high voltage pulse which is not so high as to cause spark discharge after completion of spark discharge of the spark plug, and the high voltage pulse is applied to the center electrode of the spark plug by way of the first diode, second diode and high tension code. The voltage dividing means divides the voltage at the connecting line connecting between the cathode of the first diode and the anode of the second diode so that the voltage at the connecting line is included within an allowable output range of the misfire detecting means. In the case where normal combustion occurs in a cylinder, ion current flows across the center electrode and the outer electrode of the spark plug provided to the cylinder. Thus, when the high voltage pulse is applied, the resulting charge is discharged as ion current so that the voltage at the connecting line drops in a short time. In the case where a misfire occurs in a certain cylinder, ion current does not flow across the center electrode and the outer electrode of the spark plug provided to the cylinder. For this reason, by application of the high voltage pulse, a charge is accumulated in the connecting line. So, when the high voltage pulse is applied, the voltage at the connecting line drops gradually. In the meantime, the charge accumulated in the connecting line is cleared by discharge at the time of next spark discharge of the spark plug. On the other hand, in the case where a misfire due to discharge failure occurs in a certain cylinder, the charge caused by the high voltage pulse and the high voltage for ignition is accumulated in the connecting line. However, the charge accumulated in the connecting line is discharged by the discharge means before the pulse generating means outputs a next high voltage pulse. The distributor type ignition system having incorporated therein the misfire detecting means is constructed so that the discharge means discharges the charge, which is accumulated in the connecting line (such accumulation of charge occurs when a misfire due to discharge failure occurs) when a misfire due to discharge failure occurs, before a next high voltage pulse is outputted. For this reason, when the pulse generating means outputs a high voltage pulse, the decay characteristic of the voltage at the connecting line can be detected correctly each time, so a misfire other than a misfire due to combustion failure, i.e., a misfire due to discharge failure, that is caused by the fact that the spark plug does not fire or discharge, can be judged assuredly. In the meantime, since it is not necessary to provide the pulse generating means to each cylinders, a considerable increase in cost is not incurred.

According to a further aspect of the present invention, the above described discharge means comprises a semiconductor device selected from the group consisting of a transistor, MOS-FET and thyristor. The discharge means discharges the charge accumulated in the connecting line connecting between the secondary winding of the ignition coil or the first diode and the second diode, before the pulse generating means output a next high voltage pulse. However, in consideration of the misfire detecting characteristic of the misfire detecting means, that is, in consideration of the influence to the decay characteristic of the divided voltage, it is desired that the discharge is performed after application of a high voltage for ignition and just before a high voltage pulse is outputted. To this end, it is suitable to use a semiconductor device capable of operating at high speed. The MOS-FET is operative to serve as a diode which conducts in response to reverse voltage, thus is not broken by the reverse voltage and has a function of a zero resetting diode for relieving the negative charge remaining in a floating capacity and thereby preventing drop of voltage of the high voltage pulse. Due to this, in the case where the discharge means is constituted by MOS-FET, an effect similar to that obtained by the disposition of a zero resetting diode can be obtained. On the other hand, the withstand voltage of the diode for applying a high voltage pulse to the secondary winding and the high tension code is determined so that the diode is not broken by the voltage caused at the time of a misfire, i.e., a voltage that is induced in the secondary winding and decays while vibrating since it has no place to go. In the case where the semiconductor device is a transistor or MOS-FET, it is necessary to set the withstand voltage of the semiconductor device to be higher than that of the diode. In the meantime, for a high withstand voltage, a high grade and large capacity one is necessitated. However, in the case where the discharge means is constituted by a thyristor, it only conducts when a voltage applied thereto is higher than a withstand voltage (i.e., it is not broken), so it will suffice so long as it has a withstand voltage necessary for detection, and therefore it has no problem on the withstand voltage. Further, a thyristor of a high withstand voltage but of a small capacity can be obtained with ease. Since the discharge means is constituted by a semiconductor switch such as a transistor, MOS-FET, thyristor, it can operate at high speed. For this reason, the discharge means can be operated correctly at the timing after application of the high voltage for ignition and just before output of the high voltage pulse for detection of a misfire, so that the charge can be relieved assuredly. In the case where discharge means is constituted by MOS-FET, it can dispense with a zero resetting diode and it can be prevented from being broken by reverse voltage. In the case where the discharge means is constituted by a thyristor, a thyristor of a high withstand voltage but of a small capacity can be obtained with ease, so the part cost can be lowered. Further, it is prevented from being broken by reverse voltage since it only conducts when such a voltage is applied across it.

According to a further aspect of the present invention, the above described pulse generating means comprises a boosting coil unit having a primary coil and a secondary coil having more turns than the primary coil, and a semiconductor switching device for making current flow intermittently through the primary coil in response to a control pulse signal supplied thereto, the control signal being also supplied to the semiconductor device so that when the control pulse signal is in a high level condition the semiconductor device conducts to carry out forced discharge and when the control pulse signal is changed from a high level condition to a low level condition the high voltage pulse is generated in the secondary coil of the boosting coil unit. When the control pulse signal inputted to the semiconductor device attains a high level, the semiconductor device conducts and the discharge means forcedly discharges the charge accumulated in the secondary winding of the ignition coil or the connecting line. When the control signal changes from a high level state to a low level state, the semiconductor device is put in an insulating condition and simultaneously a high voltage pulse is produced in the secondary coil of a boosting coil unit. Since by using the control pulse signal for producing the high voltage pulse for detection of a misfire the operation of the semiconductor device of the discharge means can be controlled, a signal for controlling the semiconductor device is not required independently.

According to a further aspect of the present invention, the discharge means is connected in parallel to the voltage dividing means and comprises a resistor having a resistance which is larger than a resistance caused across electrodes of the spark plug after normal combustion. The charge accumulated in the connecting line is discharged through the resistor with a predetermined time constant. The discharge means is constituted by using a semiconductor device such as transistor, MOS-FET and thyristor and forcedly discharges the charge just before application of the high voltage pulse. By this, while it becomes possible to discharge the accumulated charge just before application of the high voltage pulse, the semiconductor device is costly. On the other hand, since it will do to discharge the charge accumulated in the ignition system before the pulse generating means outputs a next high voltage pulse, the accumulated charge can be discharged gradually with a predetermined time constant so long as such gradual discharge does not affect the misfire detecting characteristic of the misfire detecting means. In this instance, it will do to connect a resistor having a resistance larger than at least a resistance caused across the electrodes of the spark plug after normal combustion, in parallel to the voltage dividing means and discharge the accumulated charge with a predetermined time constant by using the resistor. In the meantime, the reason why the resistance of the resistor connected in parallel to the discharge means is set to be larger than that caused across the electrodes of the spark plug after normal combustion is that if the resistance of the resistor is smaller, the decay characteristic of the voltage obtained by the voltage dividing means after application of the high voltage pulse is determined by the discharge characteristic of the resistor, thus making it impossible to distinguish normal combustion from a misfire due to combustion failure or misfire due to discharge failure based on the decay characteristic. Since the resistor connected in parallel to the voltage dividing means is used for constituting the discharge means, the accumulated charge is discharged continuously with a predetermined time constant. Thus, by setting the resistance of the resistor to a relatively large value, an effect similar to that in case the semiconductor device used is obtained at a quite low cost.

It is accordingly an object of the present invention to provide a method of detecting a misfire in a gasoline internal combustion engine which can assuredly detect a misfire due to combustion failure and a misfire due to discharge failure.

It is a further object of the present invention to provide a device for carrying out the above method, which is of the above described character and which is inexpensive and does not require a large space though reliable in operation.

DETAILED DESCRIPTION OF THE PREFERRED EMBODIMENTS

Figure 10:
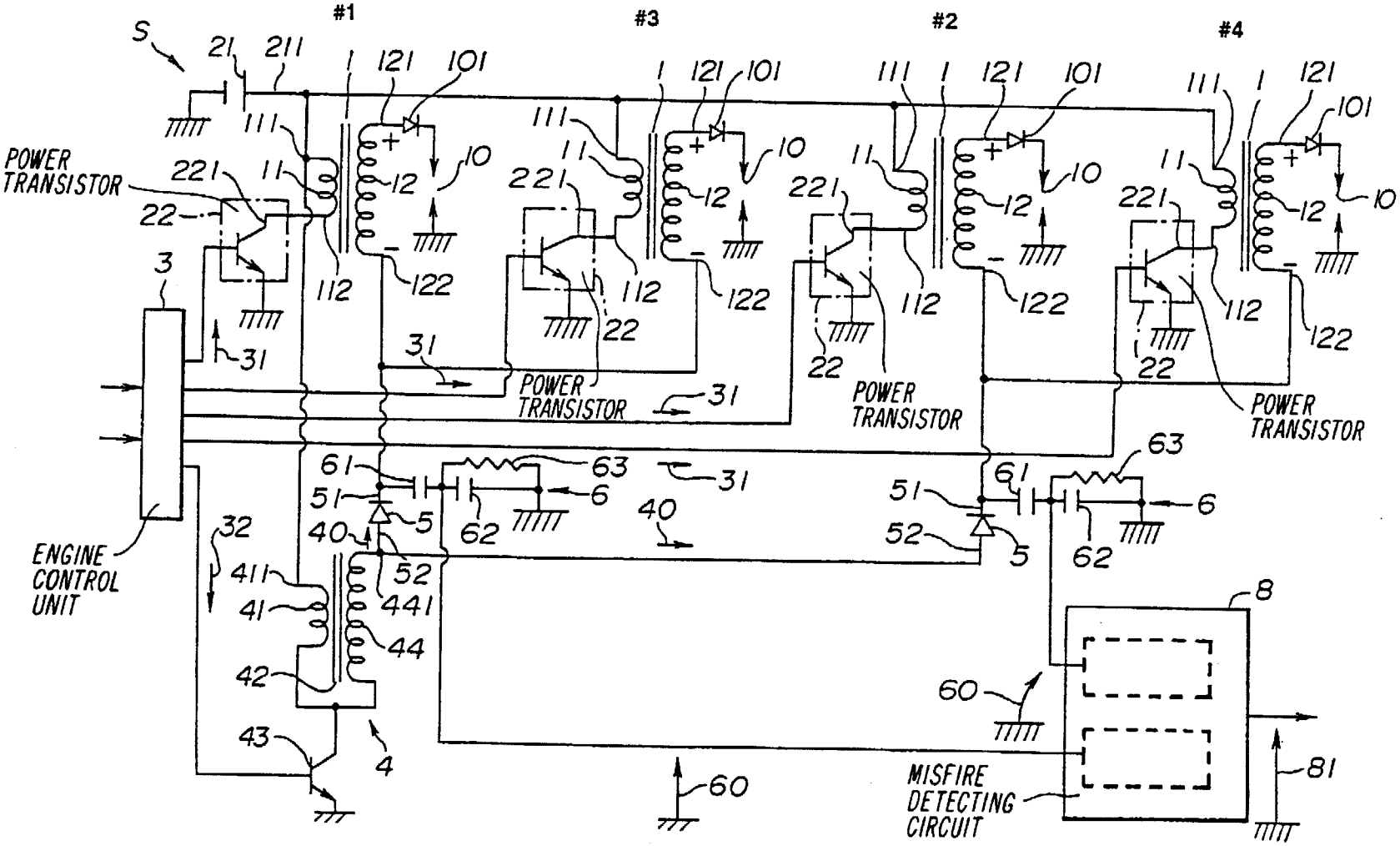
FIG. 10 is a circuit diagram having incorporated therein a misfire detecting device which is a trial product made by the applicant.

In order to meet with the demand for detection of a misfire in an internal combustion engine, a single-ended distributorless ignition system "S" having incorporated therein a combustion condition or misfire detecting device (for four-cylinder engine) shown in FIG. 10 was made by way of trial by the applicant based on the principle that charge is discharged by ion current.

Referring to FIG. 10, the single-ended misfire detecting device "S" includes ignition coils 1, a battery 21 and power transistors 22 connected to primary windings 11 of the ignition coils 1, an engine control unit (ECU) 3 for delivering ignition signals 31 to the power transistors 22, spark plugs 10 having center electrodes connected to secondary positive terminals 121 of secondary windings 12, a pulse generating circuit 4 for generating a high voltage pulse 40 in response to a pulse generation instructing signal 32, diodes 5 connected across a secondary terminal 441 and respective negative terminals 122, condenser voltage dividing circuits 6 for dividing the voltages at the cathode sides of the diodes 5, and a combustion condition or misfire detecting circuit 8 for detecting a combustion condition or misfire on the basis of the decay characteristics of the divided voltages 60, etc. (e.g., on the basis of the time during which a comparison output with respect to an amplification output curve 601 and a peak hold is maintained at a high level).

Figure 3:
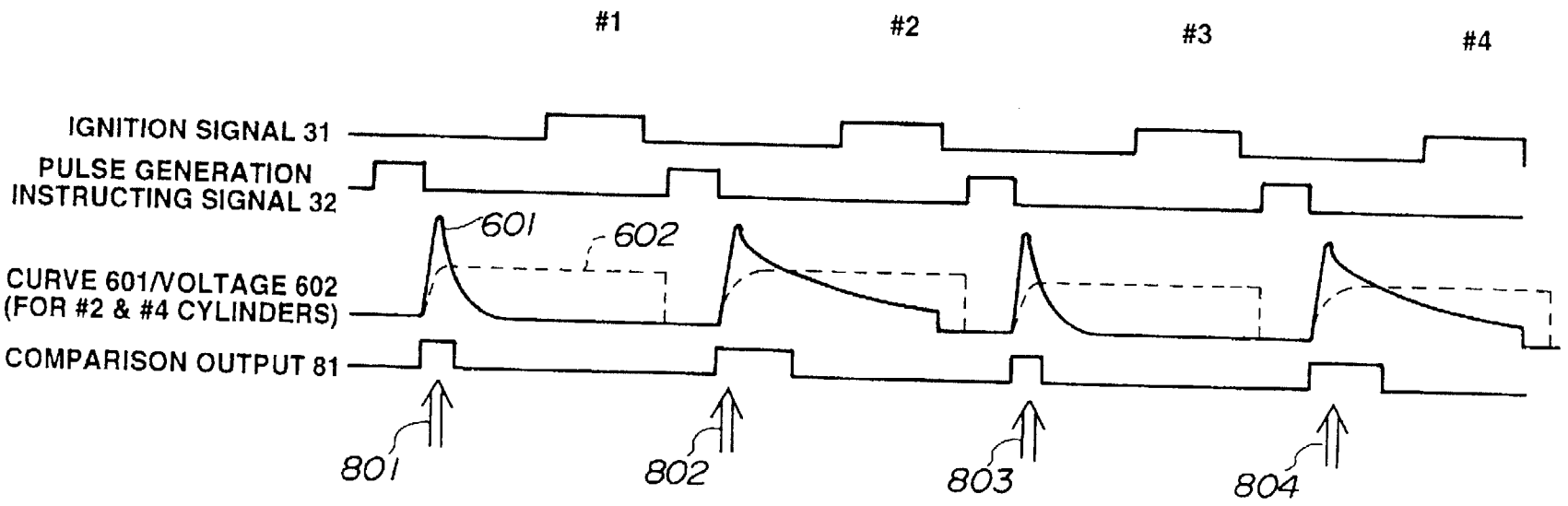
FIG. 3 is a chart of various signal and output waveforms in the ignition system of FIG. 1 when normal combustion takes place at each cylinders.

In the single-ended distributorless ignition system "S", when all of the spark plugs fire or ignite the fuel normally, signals exhibit such waveforms shown in FIG. 3.

The high voltage pulse 40 which is to be applied after firing of one of the spark plugs 10, is applied to the spark plugs 10 of all of the cylinders.

For example, at the elapsed times 802 and 804, any of the spark plugs 10 for a #2 cylinder and #4 cylinder is not yet fired, so the amplification output curve 601 accompanied by the high voltage pulse 40 applied to the secondary windings 12 of the #2 cylinder and #4 cylinder, drops gradually.

Further, at elapsed times 801 and 803, it is the time just after the spark plug 10 of the #4 cylinder or #2 cylinder has fired, so that ion current flows and the amplification output curve 601 accompanied by the high voltage 40 applied to the secondary windings 12 of the #4 cylinder and #2 cylinder drops rapidly. Due to this, the misfire detecting section of the misfire detecting circuit 8 allotted to the #4 cylinder and #2 cylinder judges at the elapsed times 801 and 803 and based on the comparison output 81 of the short pulse width that normal combustion is carried out at the #4 cylinder and #2 cylinder.

Figure 11:
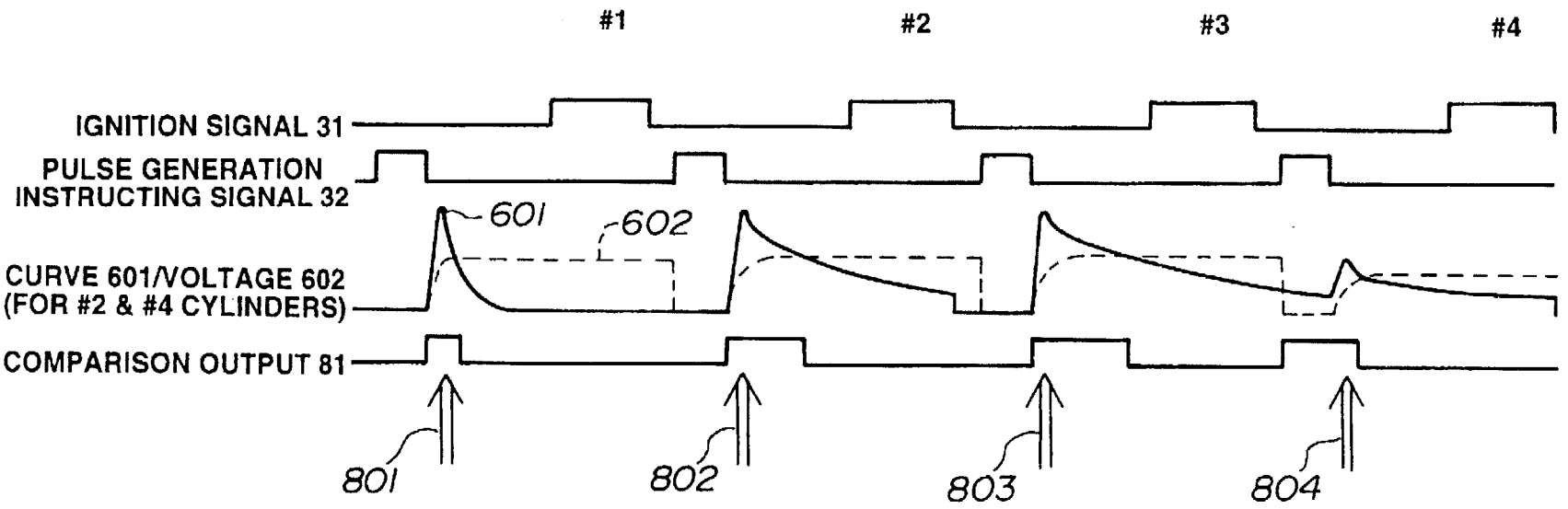
FIG. 11 is a chart of various signal and output waveforms in the ignition system of FIG. 10 when a misfire due to combustion failure takes place at a #2 cylinder.

In the case where a misfire due to combustion failure (i.e., a misfire caused by the fact that the spark plug fires or discharges but combustion of the fuel does not take place) of the spark plug 10 for the #2 cylinder occurs, signals exhibit such waveforms shown in FIG. 11.

In this case, a gradually decaying amplification output curve 601 is obtained at the elapsed time 803 due to the charge caused by the high voltage pulse 40 which is applied by way of the secondary winding 12 to the spark plug 10 for the #2 cylinder since ion current does not flow. For this reason, the misfire detecting section of the misfire detecting circuit 8 allotted to the #2 cylinder and #4 cylinder judges at the elapsed time 803 and based on the comparison output 81 of the long pulse width that a misfire is caused at the #2 cylinder.

In the meantime, the charge caused by the high voltage pulse which is applied to the spark plug 10 for the #2 cylinder for detection of a misfire of the #2 cylinder, remains until the spark plug 10 for the #4 cylinder performs spark discharge.

Figure 12:
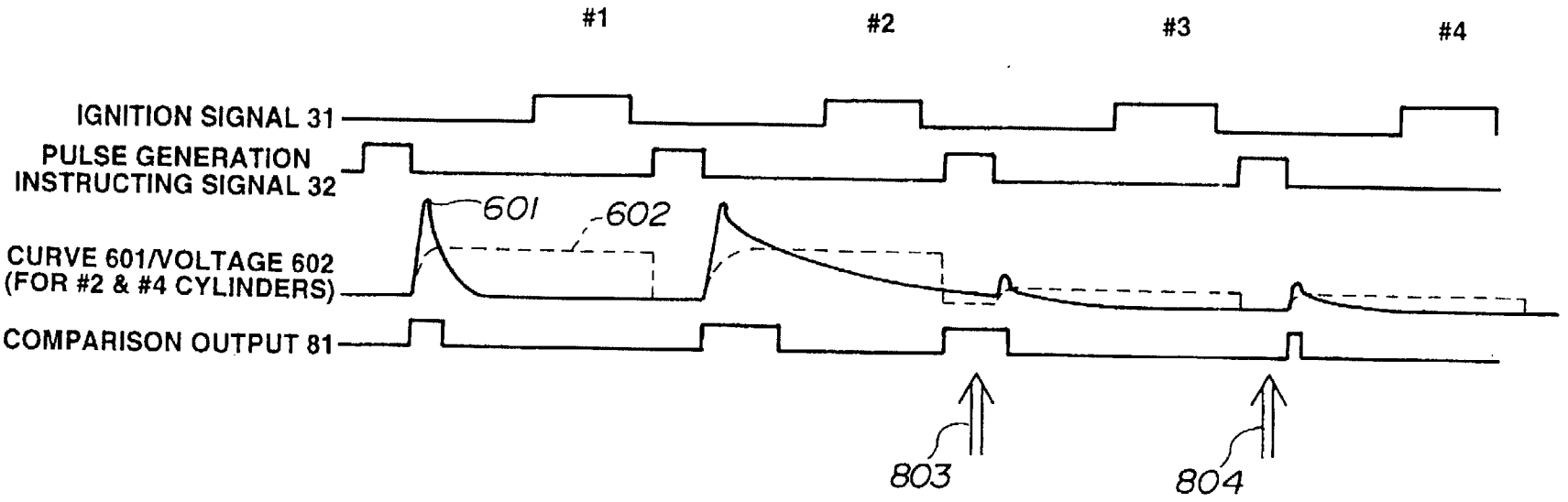
FIG. 12 is a chart of various signal and output waveforms in the ignition system of FIG. 10 when a misfire due to discharge failure takes place at the #2 cylinder.

In the case where a misfire due to discharge failure (i.e., a misfire caused by the fact that the spark plug does not fire or discharge) of the spark plug 10 for the #2 cylinder occurs, signals exhibit such wave shapes shown in FIG. 12.

In this case, the charge caused by the high voltage pulse 40 which is applied to the secondary winding 12 for the #2 cylinder for detection of misfire of the #1 cylinder remains even after elapse of the spark discharge timing for the #2 cylinder, so even if application of the high voltage pulse 40 is made for detection of a misfire of the #2 cylinder, a normal amplification output curve 601 cannot be obtained (at the elapsed time 803) and from this time onward it becomes impossible for the misfire detecting section of the misfire detecting device 8 allotted to the #2 cylinder and #4 cylinder to make judgment on a misfire. In the meantime, a misfire due to discharge failure is caused in the case where the high tension code is disconnected from the spark plug (or in the case of their defective contact or breakage of the high tension code), or in the case where the required voltage becomes excessively high at engine high speed and high load.

By providing each cylinder with a booster coil unit 412, a diode 5 and a condenser voltage dividing circuit 6, the above disadvantage can be overcome but considerably increase in cost is incurred and the space for arrangement of them becomes so large. The present invention aims at solving such a problem.

Referring now to FIGS. 1 to 5, a distributorless ignition system having incorporated therein a misfire detecting device according to an embodiment of the present invention is generally indicated by "A" and shown as being of the type for use in a four-cylinder engine. The ignition system includes ignition coils 1, a battery 21 and power transistors 22 connected to respective primary windings 11 of the ignition coils 1, an engine control unit (ECU) 3 for delivering an ignition signal 31 to the respective power transistors 22, spark plugs 10 connected to secondary windings 12 of the ignition coils 1, a pulse generating circuit 4 for producing a high voltage pulse 40, diodes 5, condenser voltage dividing circuits 6 for dividing the voltages at the cathode sides 51, discharge circuits 7 for forcedly relieving the charge accumulated at the secondary winding 12 side, and a misfire detecting circuit 8 for receiving a divided voltage (i.e., a fraction of the total voltage) 60.

Each of the ignition coils 1 (of single-ended distributorless ignition type) is composed of hundreds of turns of a primary winding 11 and tens of thousands of turns of a secondary winding 12 which are wound on an iron core. The iron core is formed from a plurality of thin silicon steel plates which are stacked one upon another. The windings are placed in a casing filled with resin (epoxy or the like). Each ignition coil 1 is a boosting coil having a primary terminal 111, a primary terminal 112, a secondary high voltage positive terminal 121 and a secondary negative terminal 122 one by one. The primary terminals 111 and 112 and the secondary negative terminal 122 are lead to the outside by means of connectors, and the secondary high voltage positive terminal 121 is connected to the spark plug 10 by way of a high tension rod.

The primary winding 111 of each of the ignition coils 1 is connected to a positive terminal 211 of the battery 21, whilst a primary terminal 112 is connected to a collector 221 of the power transistor 22.

The secondary high voltage positive terminals 121 of the ignition coils 1 are connected to the center electrodes of the spark plugs 10 by using high tension rods and by interposing therebetween erroneous ignition preventing diodes 101, respectively. In the meantime, indicated by 13 are zero resetting diodes for relieving negative charges induced at the secondary winding 12 sides.

The power transistors 22 for allowing battery current to flow intermittently and in turn through the primary windings 11 of the respective ignition coils 1 are put into an ON/OFF condition in response to an ignition signal 31 delivered from the engine control unit 3 and make the secondary winding 12 develop a high voltage of several tens kilovolts when operated to change from the ON condition to the OFF condition.

The engine control unit 3 determines an optimum ignition timing on the basis of various signals from an engine speed sensor, a coolant temperature sensor, a cam position sensor, etc. and delivers an ignition signal 31 to the power transistors 22 so that spark discharge takes place at the optimum ignition timing. Further, engine control unit 3 determines, on the basis of the determined optimum ignition timing, a timing for delivering a high voltage pulse 40 and delivers a pulse generation instructing signal 32.

In this embodiment, "primary current supplying means" is constituted by the engine control unit 3 and the power transistors 22.

The spark plugs 10 are installed on the respective engine cylinders one by one and each adapted to fire or perform spark discharge when receiving a positive high voltage at the center electrode during a compression stroke.

The pulse generating circuit 4 in this embodiment is composed of a boosting coil unit 42 connected at a primary contact 411 of a primary coil 41 to the positive terminal 211 of the battery 21, and a power transistor 43 connected at a collector to an internal connecting terminal 412. The power transistor 43 is biased off or turned on in response to the pulse generation instructing signal 32 delivered from the engine control unit 3 and causes a high voltage (about 3 kilovolts in this embodiment) which is not causative of spark discharge, to be produced at a secondary terminal 441 of a secondary coil 44 when biased off from a turned on condition.

The diodes 5 which are high withstand voltage diodes for preventing reverse current, are connected at each anodes 52 to the secondary terminal 441 and at each cathodes 51 to the secondary negative terminals 122 of the ignition coils 1 for the respective cylinders. By this, a positive polarity high voltage pulse 40 delivered from the pulse generating circuit 4 is applied to each spark plugs 10 whilst the high voltage accumulated in the spark plugs 10 is prevented from flowing back to the pulse generating circuit 4.

Each of the condenser voltage dividing circuits 6 is composed of a small capacity condenser 6t connected at an end to the cathode 51 of the diode 5 and a comparatively large capacity condenser 62 connected at an end to the other end of the condenser 61 and grounded at the other end, and a resistor 63 of a high resistance connected in parallel to the condenser 62.

By the capacity ratio of the condensers 61 and 62, the voltage at the cathode 51 side is divided, and the divided voltage 60 is supplied to the misfire detecting circuit 8.

Figure 2A:
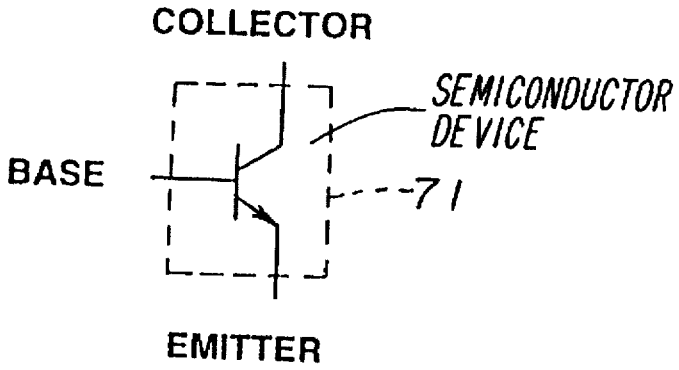
FIGS. 2A to 2C are diagrammatic views for illustrating connection of semiconductor devices for use in a discharge circuit of the ignition system of FIG. 1.
Figure 2B:
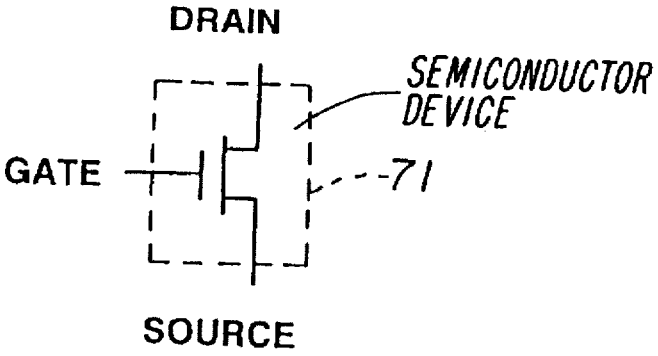
Figure 2C:
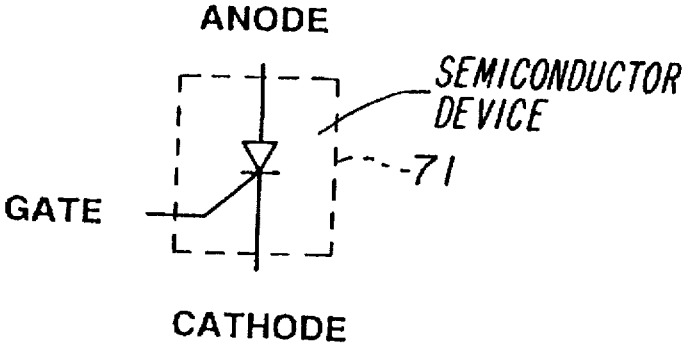

Each of the discharge circuits 7 is composed of a semiconductor device 71 such as a transistor, MOS-FET, thyristor as shown in FIGS. 2A, 2B and 2C, and a resistor 72 connected across the collector (or drain, or anode) and the secondary negative terminal 122. The emitter (or source, or cathode) of each semiconductor device 71 is grounded, and the base (or gate) of each semiconductor device 71 receives the pulse generation instructing signal 32 as an input.

The semiconductor devices 71 of the discharge circuits 7 conduct during the time when the pulse generation instructing signal 32 is maintained at a high level (after an ignition timing), and forcedly relieve the charges accumulated at the secondary winding 12 sides.

The misfire detecting circuit 8 detects a misfire at each cylinders provided with the spark plugs 10 on the basis of how each divided voltage 60 drops, in the following manner.

Referring to FIG. 3, various signal voltage and output voltage variations in the ignition system when normal combustion has taken place will be described with respect to the #4 and #2 cylinders.

At the elapsed times 801 and 803 which are just after spark discharge of the spark plugs 10 for the #4 and #2 cylinders, ion current flows so that the amplification output curve 601 caused by the high voltage pulse 40 which is applied to the secondary windings 12 of the ignition coils 1 for the #2 and #4 cylinders, drops rapidly. Due to this, the misfire detecting section of the misfire detecting circuit 8 allotted to the #2 and #4 cylinders judges at the elapsed times 801 and 803 and on the basis of a comparison output 81 of a short pulse width that normal combustion has taken place at the #4 and #2 cylinders.

In this instance, at the elapsed times 802 and 804, none of the spark plugs 10 for the #2 and #4 cylinders has yet discharged so that the amplification output curve 601 caused by the high voltage pulse 40 which is applied also to the secondary windings 12 for the #2 and #4 2O cylinders simultaneously with application of the high voltage pulse 40 for the purpose of detection of a misfire at the #1 and #3 cylinders, drops gradually.

In the meantime, the residual charge caused by the high voltage pulse 40 which is applied to the secondary windings 12 for the #2 and #4 cylinders simultaneously with application of the high voltage pulse 40 for the purpose of detection of a misfire at the #1 cylinder and #3 cylinder, is all discharged at the time of firing of the #2 and #4 cylinders and is therefore already cleared at the elapsed times 803 and 801 when the high voltage pulse 40 is to be applied for detection of a misfire at the #2 and #4 cylinders, thus not causing any problem.

Figure 4:
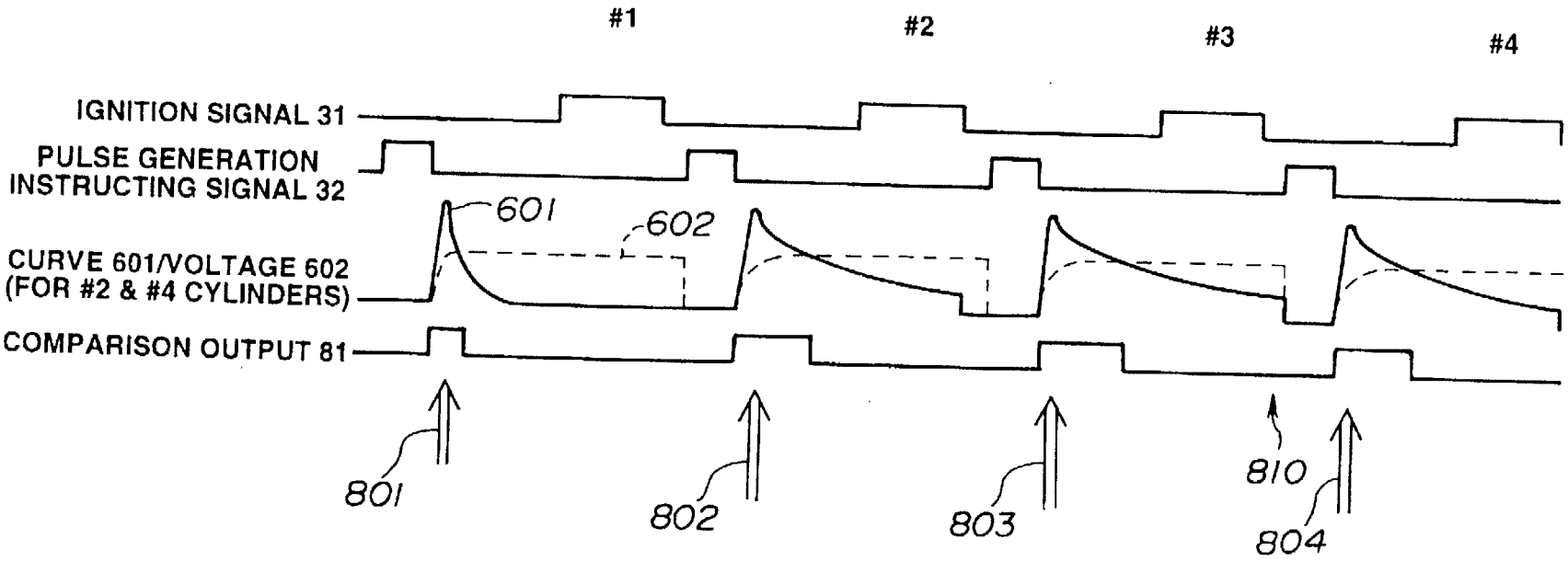
FIG. 4 is a chart of various signal and output waveforms in the ignition system of FIG. 1 when a misfire due to combustion failure takes place at a #2 cylinder.

Referring to FIG. 4, various signal voltage and output voltage variations in the ignition system when a misfire due to combustion failure has occurred, will be described with respect to the #4 and #2 cylinders.

At the elapsed time 801, which is just after spark discharge of the spark plug 10 for the #4 cylinder takes place, ion current flows so that the amplification output curve 601 caused by the high voltage pulse 40 which is applied Co the secondary windings 12 of the ignition coils 1 for the #2 cylinder and #4 cylinder, drops rapidly. Due to this, the misfire detecting section of the misfire detecting circuit 8 allotted to the #2 and #4 cylinders judges at the elapsed time 801 and on the basis of the comparison output 81 of a short pulse width that normal combustion has taken place at the #4 cylinder.

At the elapsed times 802 and 804, none of the spark plugs 10 for the #2 cylinder and #4 cylinder has yet discharged so that the amplification output curve 601 caused by the high voltage pulse 40 which is applied also to the secondary windings 12 for the #2 cylinder and #4 cylinder simultaneously with application of the high voltage pulse 40 for detection of a misfire at the #1 and #3 cylinders, drops gradually. In the meantime, the residual charge caused by the high voltage pulse 40 which is applied to the secondary windings 12 for the #2 and #4 cylinders simultaneously with application of the high voltage pulse 40 for the purpose of detecting a misfire at the #1 and #3 cylinders, is all discharged at the time of spark discharge of the #2 and #4 cylinders and is thus already cleared at the elapsed times 803 and 801 when the high voltage pulse 40 is to be applied for detection of a misfire at the #2 and #4 cylinders, thus not causing any problem.

At the elapsed time 803 which is just after a misfire due to combustion failure of the spark plug 10 for the #2 cylinder has occurred, ion current does not flow so that the amplification output curve 601 caused by the high voltage pulse 40 which is applied to the secondary windings 12 of the ignition coils 1 for the #2 cylinder and #4 cylinder, drops gradually. For this reason, the misfire detecting section of the misfire detecting circuit 8 allotted to the #2 and #4 cylinders judges at the elapsed time 803 and on the basis of the comparison output 81 of a long pulse width that a misfire has occurred at the #2 cylinder. In the meantime, the residual charge caused by the high voltage pulse 40 applied to the secondary winding 12 for the spark plug 10 for the #2 cylinder, is discharged all by the discharge circuit 7 at the elapsed time 810.

Figure 5:
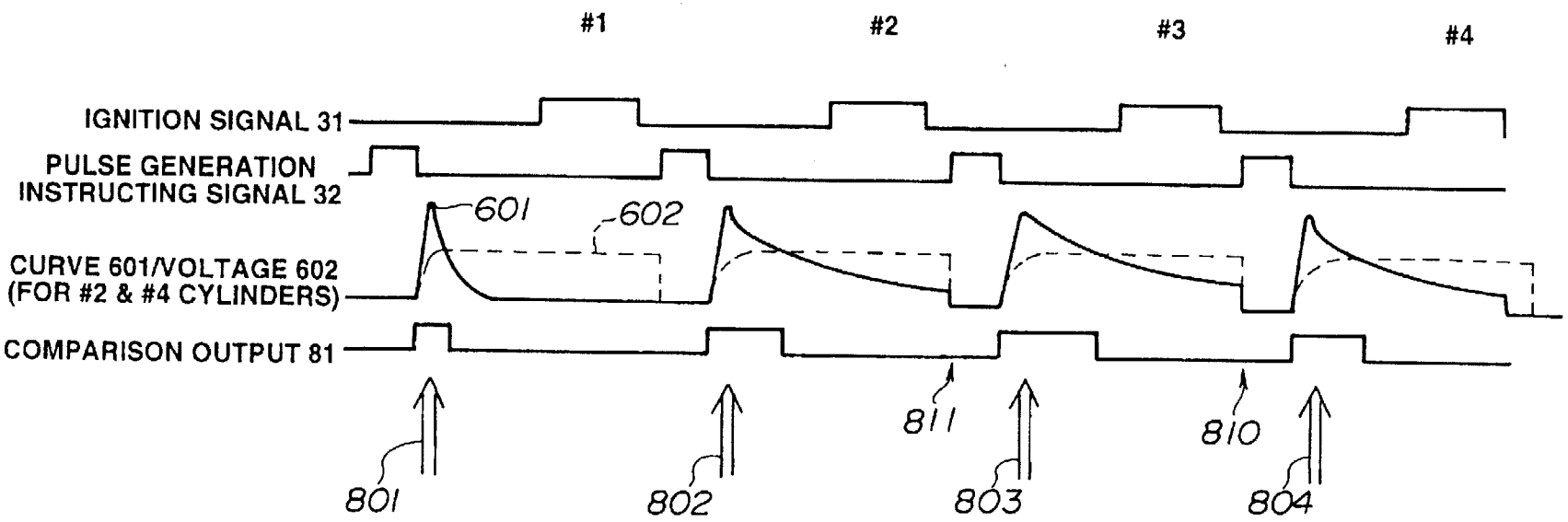
FIG. 5 is a chart of various signal and output waveforms in the ignition system of FIG. 1 when a misfire due to discharge failure takes place at the #2 cylinder.

Referring to FIG. 5, various signal voltage and output voltage variations in the ignition system when a misfire due to discharge failure has occurred will be described with respect to the #4 and #2 cylinders.

At the elapsed time 802, since it is not the timing for spark discharge of the #2 and #4 cylinders, the amplification output curve 601 caused by the high voltage pulse 40 which is applied to the secondary windings 12 of the ignition coils 1 for the #2 and #4 cylinders, drops gradually. Further, because of a misfire due to discharge failure at the #2 cylinder, spark discharge does not take place at the timing of spark discharge for the #2 cylinder, the charge is all discharged at the elapsed time 811 by means of the discharge circuit 7.

At the elapsed time 803, since it is the time after a misfire due to discharge failure of the spark plug 10 for the #2 cylinder has occurred, the charge is not discharged so that the amplification output curve 601 caused by the high voltage pulse 40 which is applied to the secondary windings 12 of the ignition coils 1 for the #2 and #4 cylinders, drops gradually. For this reason, the misfire detecting section of the misfire detecting circuit 8 allotted to the #2 and #4 cylinders judges at the elapsed time 803 and on the basis of the comparison output 81 of a long pulse width that the misfire has occurred at the #2 cylinder. In the meantime, the residual charge caused by the high voltage pulse 40 which is applied to the spark plug 10 for the #2 cylinder is all discharged at the elapsed time 810 by means of the discharge circuit 7.

In the meantime, a misfire due to discharge failure is caused in the case where the high tension code is disconnected from the spark plug (or in the case of their defective contact or breakage of the high tension code), or in the case where the required voltage becomes excessively high at engine high speed and high load.

Then, the advantages of this embodiment will be described.

(a) The single-ended distributorless ignition system "A" having incorporated therein a misfire detecting device is constructed so as to forcedly relieve the charge which is accumulated at the secondary winding 12 side of the ignition coil 1 as a result of a misfire due to discharge failure, by means of the discharge circuit 7 which operates in response to the pulse generation instructing signal 32 in a high level condition.

As a result, the decay characteristic of the voltage (which is caused by the application of the high voltage pulse 40) at the cathode 51 side of the diode 5 can be observed correctly each time, so assured and reliable judgment on misfire due to combustion failure and misfire due to discharge failure can be attained. In the meantime, this embodiment requires one pulse generating circuit 4, two condenser voltage dividing circuits 6 and two diodes 5, thus not increasing the cost considerably and not requiring a considerably large space for their disposition.

(b) Since MOS-EFT has a function to serve as a diode which conducts in response to reverse voltage, it is not broken by the reverse voltage and also has a function to double as zero resetting diodes 13 for relieving negative charge remaining in the floating capacity for thereby preventing drop of the voltage of the high voltage pulses 40. For this reason, in the case where the semiconductor devices 71 are MOS-FET, the zero resetting diodes 13 can be dispensed with.

(c) The withstand voltage of the diode 5 which applies the high voltage pulse 40 to the secondary winding 12 and high tension code, is determined so as not to be broken by the voltage at the time of misfire due to discharge failure (i.e., high voltage which is produced in the secondary winding 12 for spark discharge but has nowhere to go, so decays whilst vibrating). In the case where the semiconductor device 71 is a transistor or MOS-FET, it is necessary to set the withstand voltage of the semiconductor device 71 higher than the withstand voltage of the diode. In the meantime, in the case where the semiconductor device 71 is a transistor or MOS-FET and its withstand voltage is high, it will be of a high value and of a large capacity.

However, in the case where the semiconductor device 71 is a thyristor, it just conducts when subjected to a voltage higher than the withstand voltage (so it is not broken). So, its withstand voltage can be set so as to withstand only the voltage for detection, whilst it has no problem on reverse voltage. Further, a thyristor of a small capacity but of a high withstand voltage, can be obtained with ease, thus making it possible to reduce the cost.

(d) Since the operation of the semiconductor device 71 of the discharge circuit 7 is controlled by using a pulse generation instructing signal for generating a high voltage pulse 40, there is no necessity of producing a signal for controlling the semiconductor device 71 independently at the engine control unit 3.

Figure 6:
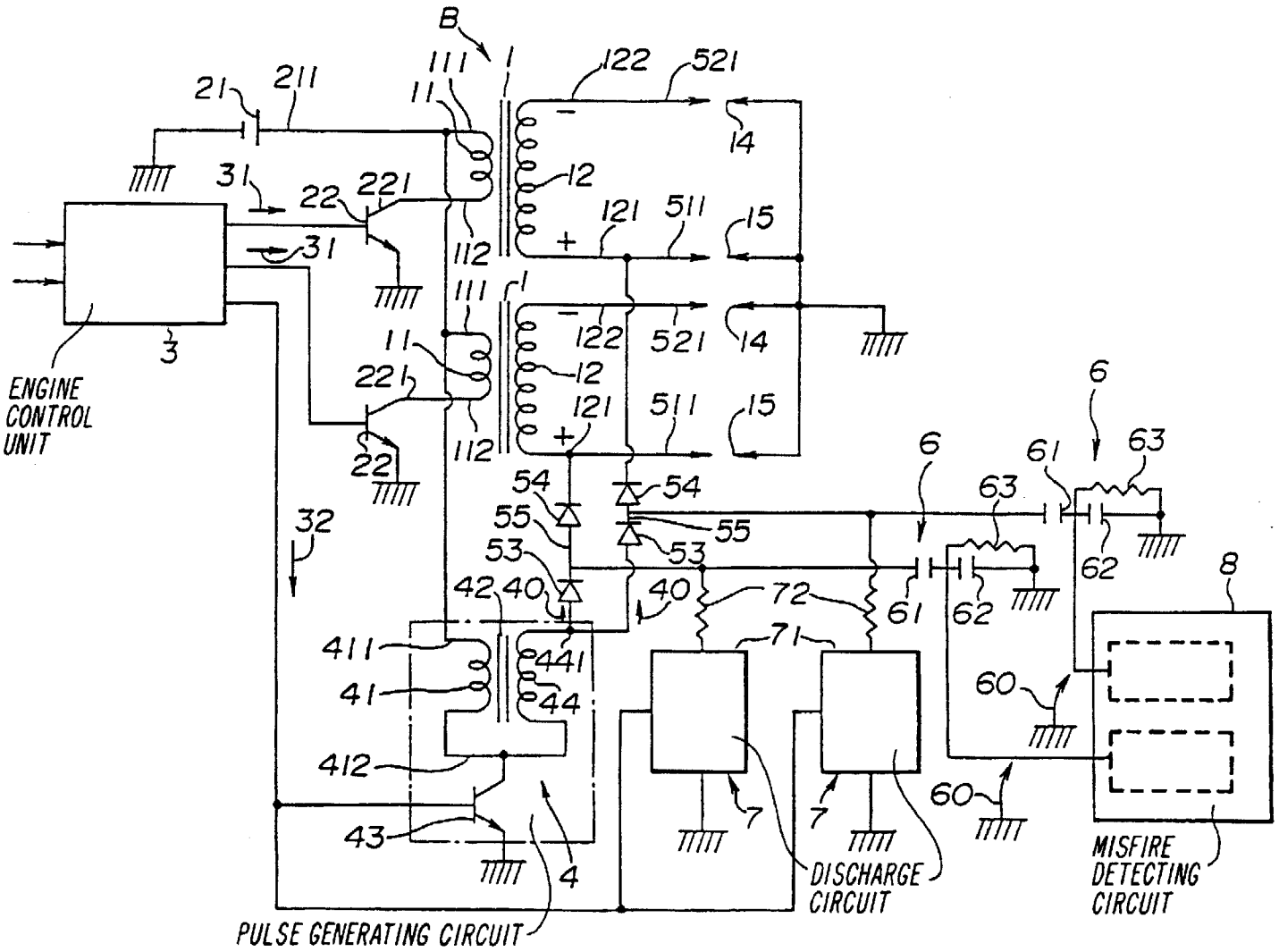
FIG. 6 is a circuit diagram of a double-ended distributorless ignition system having incorporated therein a misfire detecting device according to another embodiment of the present invention.

Referring to FIG. 6, a further embodiment of this invention will be described. A double-ended distributorless ignition system having incorporated therein a misfire detecting device according to a further embodiment is generally indicated by "B" and shown as being of the type for use in a four-cylinder gasoline engine. The ignition system includes ignition coils 1, a battery 21 and power transistors 22 connected to respective primary windings 11 of the ignition coils 1, an engine control unit (ECU) 3 for delivering an ignition signal 31 to each power transistors 22, spark plugs 14 connected at a center electrode side to secondary negative terminals 122 (hereafter called "secondary high voltage negative terminals" since a high negative voltage is build up in the terminals in a double-ended distributorless ignition system), spark plugs 15 connected at the center electrode sides to secondary high voltage positive terminals 132, a pulse generating circuit 4 for producing a high voltage pulse 40, diodes 53, diodes 54, condenser voltage dividing circuits 6 for dividing the voltage at connecting lines 55, discharge circuits 7 for forcedly relieving the charge accumulated in the connecting lines 55, and a misfire detecting circuit 8 for receiving a divided voltage (i.e., a fraction of the total voltage) 60.

Each of the ignition coils 1 (of simultaneous ignition type) is composed of hundreds of turns of the primary winding 11 and tends of thousands of turns of a secondary winding 12 which are wound on an iron core. The iron core is formed from a plurality of thin silicon steel plates which are stacked one upon another. The windings are placed in a casing filled with resin (epoxy or the like). Each ignition coil 1 has, on the top face of the casing, primary terminals 111 and 112, a secondary high voltage positive terminal 121, and a secondary high voltage negative terminal 122 which are independent from each other.

The primary winding 111 of each of the ignition coils 1 is connected to a positive terminal 211 of the battery 2, whilst a primary terminal 112 is connected to a collector 221 of the power transistor 22.

The secondary high voltage positive terminal 121 and the secondary high voltage negative terminal 122 of each ignition coil 1 are connected to the center electrodes of the spark plugs 15 and 14 by way of high tension codes 511 and 521, respectively.

The power transistors 22 for allowing battery current to flow intermittently and in turn through the primary windings 11 are put into an ON/OFF condition in response to an ignition signal 31 delivered from the engine control unit 3 and make the secondary winding 12 develop a high voltage of several tens kilovolts when operated to change from the ON condition to the OFF condition.

The engine control unit 3 determines an optimum ignition timing on the basis of various signals from an engine speed sensor, a coolant temperature sensor, a cam position sensor, etc. and delivers an ignition signal 31 so that spark discharge takes place at the optimum ignition timing. Further, the engine control unit 3 determines, on the basis of the determined optimum ignition timing, a timing for delivering a high voltage pulse 40 and delivers a pulse generation instructing signal 32 to the pulse generating circuit 4.

In this embodiment, "primary current supplying means" is constituted by the engine control unit 3 and the power transistors 22.

The spark plugs 14 and 15 are installed on the respective engine cylinders and adapted to fire or perform spark discharge when receiving a positive high voltage (spark plug 15) and a negative high voltage (spark plug 14) during a compression stroke and an exhaust stroke. In the meantime, since the ignition system is of the double-ended type, the spark plug which is not on the firing cycle is caused to make wasteful spark discharge during an exhaust stroke. However, since such firing or spark discharge is performed under a nearly atmospheric pressure condition, the required voltage and the arc maintaining voltage are both small so that the firing energy is always and mostly distributed to the spark plug on the firing cycle side.

The pulse generating circuit. 4 in this embodiment is composed of a boosting coil unit 42 connected at a primary terminal 411 of a primary coil 41 to the positive terminal 211 of the battery 21, and a power transistor 43 connected at a collector to an internal connecting terminal 412. When the power transistor 43 is biased off from a turned on condition, a high voltage (about 3 kilovolts in this embodiment) which is not causative of spark discharge, is produced at the secondary terminal 441 of the secondary winding 44.

The diodes 53 (first diodes) are connected at the anodes to the secondary terminal 441 and at the cathodes to the anodes of the respective diodes 54.

The diodes 54 (second diodes) are connected at the anodes to the cathodes of the respective diodes 53 and at the cathodes to the secondary high voltage positive terminals 121 of the respective secondary windings 12.

The diodes 53 and 54 are constructed and arranged so as to apply the positive polarity pulse 40 (about 3 kV) delivered from the pulse generating circuit 4 to the secondary high voltage positive terminal 121 whilst preventing a high voltage of a positive potential produced at the secondary high voltage positive terminal 121 from flowing back to the pulse generating circuit 4.

Each of the capacitor voltage dividing circuits 6 is composed of a capacitor 61 of a small capacity (several pF) connected at an end to the connecting line 55 and a capacitor 62 of a comparatively large capacity (several thousands pF) which are connected in series, and a resistor 63 of a high resistance connected in parallel to the capacitor 62.

For example, in the case of the capacities being 5 pF and 1500 pF, the voltage dividing ratio is 1/300, so the voltage at the connecting line 55 is divided and reduced to 1/300 of the total voltage and the divided voltage 60 is supplied as an input to the misfire detecting device 8.

Each of the discharge circuits 7 is composed of a semiconductor device 71 shown in FIGS. 2A to 2C, and a resistor 72 (several kΩ) connected to the connecting line 55. The emitter (or source, or cathode) of each semiconductor 7 is grounded, and the base (or gate) of each semiconductor 71 is supplied with the pulse generation instructing signal 32.

The semiconductor devices 71 of the discharge circuits 7 are adapted to conduct during the time when the pulse generation instructing signal 32 is maintained at a high level (after an ignition timing) and forcedly relieve the charges accumulated in the connecting lines 55.

The misfire detecting circuit 8 detects a misfire at each cylinders provided with the spark plugs 10 on the basis of how the divided voltage 60, which appears as a result of application of the high voltage pulse 40, drops or decays, in such a manner as will be described hereinbelow.

When normal combustion has taken place, ion current flows across the center electrode and the outer electrode of the spark plug 15, so the divided voltage 60 which appears as a result of application of the high voltage pulse 40, decays in a short time and the misfire detecting circuit 8 judges that normal combustion has taken place.

When a misfire due to combustion failure has occurred, ion current does not flow across the center electrode and the outer electrode of the spark plug 15, so the divided voltage 60 which appears as a result of application of the high voltage pulse 40, drops gradually and the misfire detecting device 8 judges that the misfire has occurred. In the meantime, the charge caused by the application of the high voltage pulse 40 is discharged at the time of the next spark discharge.

When a misfire due to discharge failure has occurred, the charge is accumulated and the divided voltage 60 appearing as a result of application of the high voltage pulse 40 drops gradually, so the misfire detecting circuit 8 judges that the misfire has occurred. In the meantime, since spark discharge does not occur, the charge caused by the application of the high voltage pulse 40 is not discharged at the timing for spark discharge but just before application of the next high voltage pulse 40 the semiconductor device 71 of the discharge circuit 7 conducts and forcedly relieves the charge accumulated in the connecting line 55 therefrom.

Then the advantage of this embodiment will be described.

(e) The double-ended distributorless ignition system "B" is constructed so as to forcedly relieve the charge which is accumulated in the connecting line 55, by means of the discharge circuit 7 which is operated by the pulse generation instructing signal 32 in a high level condition.

For this reason, the decay characteristic of the voltage at the connecting line 55, which voltage is caused by the application of the high voltage pulse 40, can be observed correctly each time, so judgment on a misfire due to combustion failure and a misfire due to discharge failure can be made assuredly. In the meantime, since the misfire detecting device of this embodiment requires one pulse generating circuit 4, two voltage dividing circuits 6, and two diodes 53, it does not increase the cost and the space for its arrangement considerably.

This embodiment also has the advantages similar to the above described advantages (c) and (d).

Figure 7:
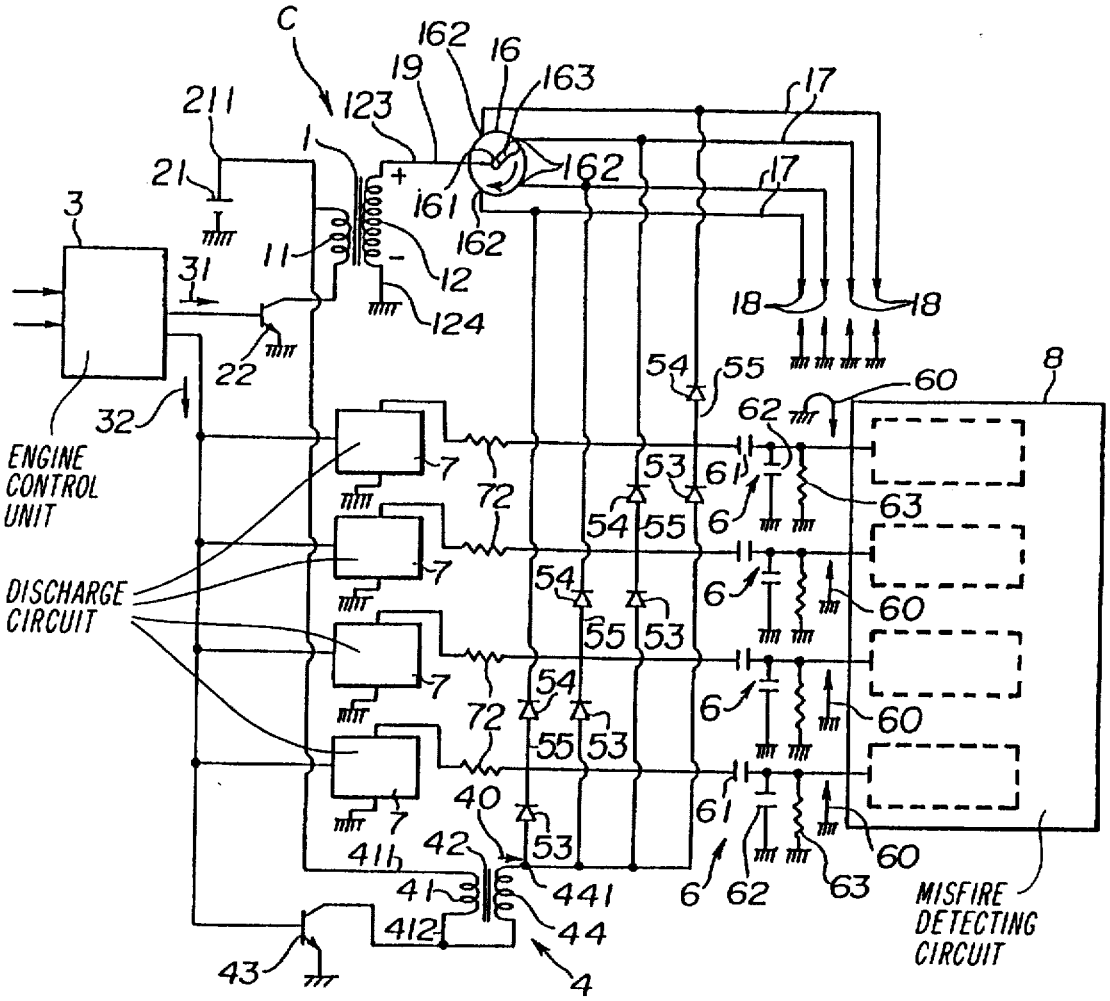
FIG. 7 is a circuit diagram of a distributor type ignition system having incorporated therein a misfire detecting device according to a further embodiment of the present invention.

Referring to FIG. 7, a further embodiment of this invention will be described. A distributor type ignition system having incorporated therein a misfire detecting device of this embodiment is generally indicated by "C" and includes an ignition coil 1, a battery 21 and a power transistor 22 connected to a primary winding 11, an engine control unit 3 for delivering an ignition signal to the power transistor 22, a distributor 16 connected at a rotor 163 to a high voltage positive terminal 123 of a secondary winding 12, spark plugs 18 each provided to each cylinder, connected at center electrodes to respective side electrodes 162 by way of high tension codes 17 and grounded at outer electrodes, a pulse generating circuit 4 for generating a high voltage pulse 40 of positive polarity, diodes 53, diodes 54, capacitor voltage dividing circuits 6 for dividing voltage at the connecting lines 55, discharge circuits 7 for forcedly relieving the charge accumulated in the connecting lines 55, and a misfire detecting circuit 8 receiving divided voltage 60 as an input.

Figure 1:
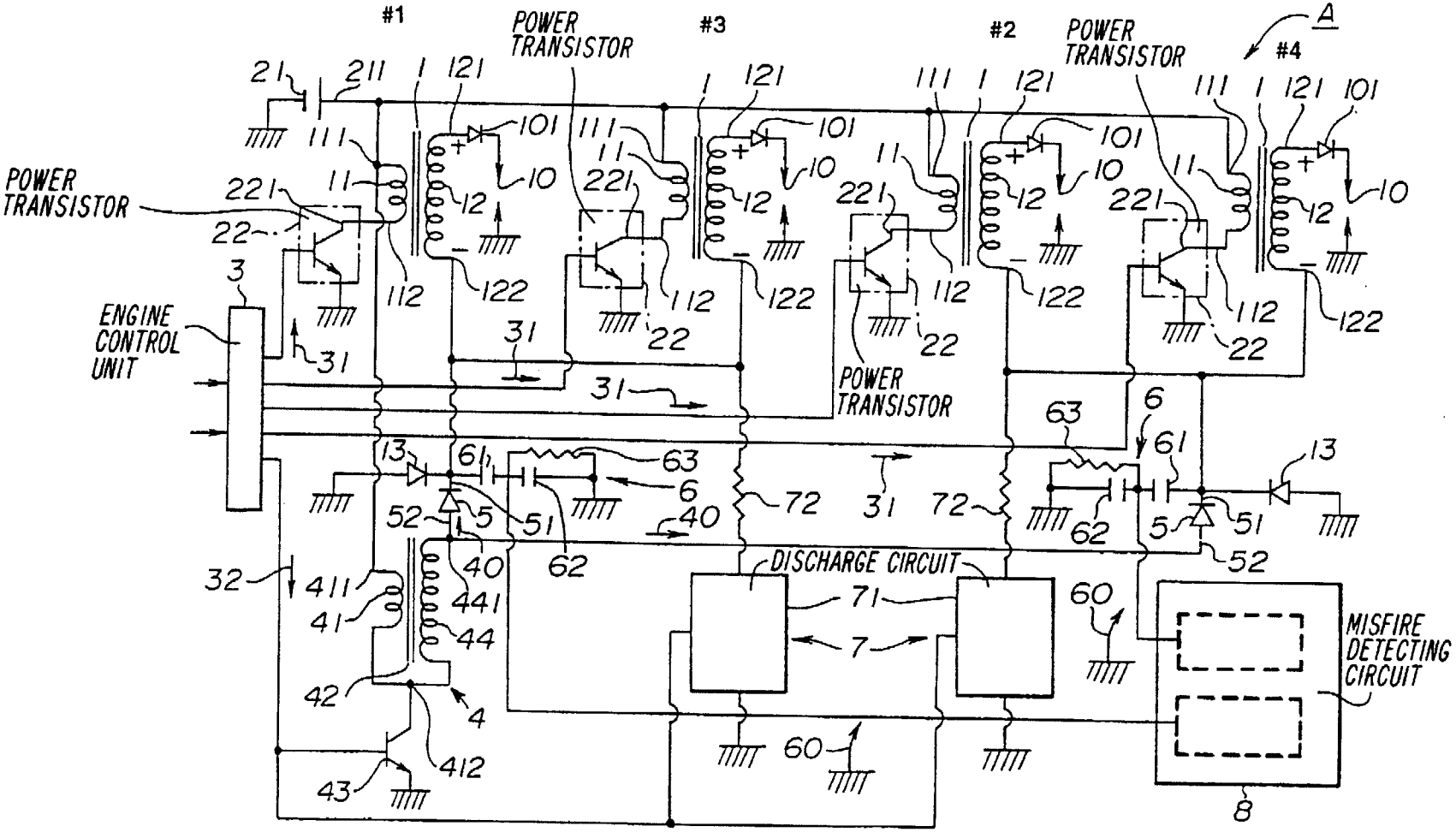
FIG. 1 is a circuit diagram of a single-ended distributorless ignition system having incorporated therein a misfire detecting device according to an embodiment of the present invention.

The ignition coil 1 has the same structure as that of the ignition system of FIG. 1 but another end (negative terminal) 124 of the secondary winding 12 is grounded.

The high voltage produced in the ignition coil 1 is transmitted by way of a center code 19 to a center electrode 161, then applied to the side electrodes 162 through transmission from a center contact piece to the rotor 163, and distributed to the spark plugs 18 by means of high tension codes 17.

The engine control unit 3 determines an optimum ignition timing on the basis of signals from an engine speed sensor, coolant temperature sensor, cam position sensor, etc. and delivers an ignition signal 31. The ignition system is constructed so that high voltage is produced at the secondary winding 12 side of the ignition coil 1 just when the rotating rotor 163 comes to face each of the side electrodes 162.

There is a gap of about 0.5 mm between the fan-shaped end of the rotor 163 and the side electrodes 162. However, for the reason of the atmospheric pressure, the high voltage for ignition can go over the gap with a quite small loss to reach the spark plugs 18.

In case of a four-stroke cycle engine, one firing stroke occurs every two revolutions of the crankshaft, so the gear ratio is determined so that the rotor 163 of the distributor 16 rotates once every two rotations of the engine crankshaft, The diodes 53 (first diodes) are connected at the anodes to the secondary terminal 441 and at the cathodes to the anodes of the diodes 54.

The diodes 54 (second diodes) are connected at the anodes to the cathodes of the diodes 53 and at the cathodes to the respective high tension codes 17.

By the diodes 53 and 54, the positive polarity pulse 40 (about 3 kilovolts) delivered by the pulse generating circuit 4 is applied to the high tension codes 17 and the high voltage for ignition is prevented from flowing back to the pulse generating circuit 4.

The pulse generating circuit 4, similarly to the embodiments of FIGS. 1 and 6, is composed of a boosting coil unit 42 connected at the primary terminal 411 of the primary coil 41 to the positive terminal 211 of the battery 21, and a power transistor 43 connected at the collector to the internal connecting terminal 412. When the power transistor 43 is changed from an ON condition to an OFF condition, a positive high voltage pulse 40 (about 3 kilovolts in this embodiment) which is not causative of spark discharge is produced in the secondary coil 44.

Each of the capacitor voltage dividing circuits 6 is composed of a capacitor 61 of a small capacity (several pF) connected at an end to the connecting line 55 and a capacitor 62 of a comparatively large capacity (several thousands pF) which are connected in series, and a resistor 63 of a high resistance connected in parallel to the capacitor 62.

For example, in the case of the capacities being 5 pF and 1500 pF, the voltage dividing ratio is 1/300, so the voltage at the connecting line 55 is divided and reduced to 1/300 of the total voltage and the divided voltage 60 is supplied as an input to the misfire detecting device 8.

Each of the discharge circuits 7 is composed of a semiconductor device 71 shown in FIGS. 2A to 2C, and a resistor 72 (several kΩ) connected to the connecting line 55. The emitter (or source or cathode) of each semiconductor device 7 is grounded, and the base (or gate) of each semiconductor device 71 receives the pulse generation instructing signal 32.

The semiconductor devices 71 of the discharge circuits 7 are adapted to conduct during the time when the pulse generation instructing signal 32 is maintained at a high level after an ignition timing and just before the pulse generating circuit 4 generates a high voltage pulse 40, and forcedly relieve the charge accumulated in the connecting line 55.

The misfire detecting circuit 8 detects a misfire at each cylinders provided with the spark plugs 18 on the basis of how the divided voltage 60, which appears as a result of application of the high voltage pulse 40, drops or decays, in such a manner as will be described hereinbelow.

When normal combustion has occurred, ion current does not flow across the center electrode-outer electrode of the spark plug 18, so the divided voltage 60 which appears as a result of application of the high voltage pulse 40, drops in a short time, and the misfire detecting device 8 judges that normal combustion has occurred.

When a misfire due to combustion failure has occurred, the charge is accumulated and the divided voltage 60, which appears as a result of application of the high voltage pulse 40, drops gradually, so the misfire detecting device 8 judges that a misfire has occurred. In the meantime, the charge accumulated as a result of application of the high voltage 40 is discharged at the time of next spark discharge.

When a misfire due to discharge failure has occurred, the charge is accumulated and the divided voltage 60 appearing as a result of application of the high voltage pulse 40 drops gradually, so the misfire detecting circuit 8 judges that the misfire has occurred. In the meantime, since spark discharge does not occur, the charge that has caused due to application of the high voltage pulse 40 is not discharged at the timing of spark discharge. However, just before application of the next high voltage pulse 40, the semiconductor device 71 of the discharge circuit 7 conducts and forcedly relieves the charge accumulated in the connecting line 55.

Then, the advantages of this embodiment will be described.

(f) The distributor type ignition system "C" having incorporated therein a misfire detecting device is constructed so as to forcedly relieve the charge which is accumulated in the connecting line 55 as a result of a misfire due to spark discharge, by means of the discharge circuit 7 which is operated by the pulse generation instructing signal 32 in a high level condition.

For this reason, the decay characteristic of the voltage at the connecting line 55, which voltage is caused by the application of the high voltage pulse 40, can be observed correctly each time, and judgment on misfire due to combustion failure and misfire due to discharge failure can be made assuredly. In the meantime, the number of the pulse generating circuit 4 is one, thus not increasing the cost and the space for arrangement considerably.

This embodiment also has advantages similar to the above described advantages (c) and (d).

While the present invention has been described and shown with respect to the embodiments as above, it is not for the purpose of limitation but various modifications and variations thereof can be made.

For example, in the above described embodiments, the ignition signal 31 may be used for providing a circuit which outputs a high level pulse to the semiconductor device 71 of the discharge circuit 7 at the time of change of the ignition signal from a high level condition to a low level condition and thereby forcedly relieves the charge accumulated in the floating capacity at that time.

Further, in the above described embodiments, the engine control unit 3 may otherwise be structured so as to separately deliver a trigger signal for triggering the semiconductor device 71 in conduction. In this case, if the semiconductor device 71 is selectively triggered in such a manner as to discharge only the charge which is accumulated in the connecting line 55 and whose decay characteristic is to be observed, the heating of the semiconductor device 71 is desiredly suppressed.

On the other hand, for the discharge means, another semiconductor, relay, switching device such as photoelectric switching device, etc. may be otherwise be used. Further, other than such a switching device, a discharge circuit may be constituted by using a resistor R as shown in FIG. 8.

Figure 8:
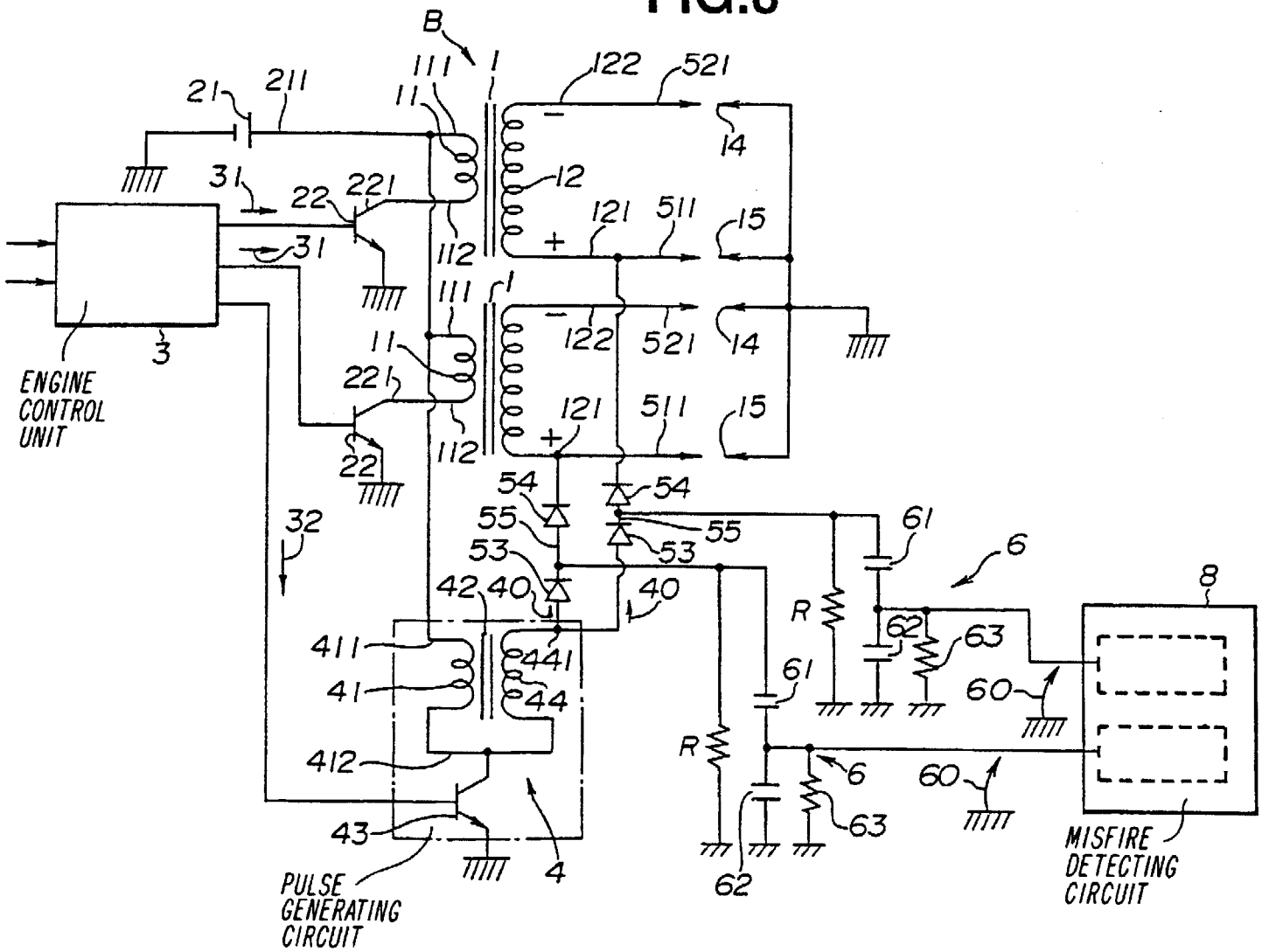
FIG. 8 is a circuit diagram of a double-ended distributorless ignition system having incorporated therein a misfire detecting device which has a discharge means constituted by using a resistor.
Figure 9:
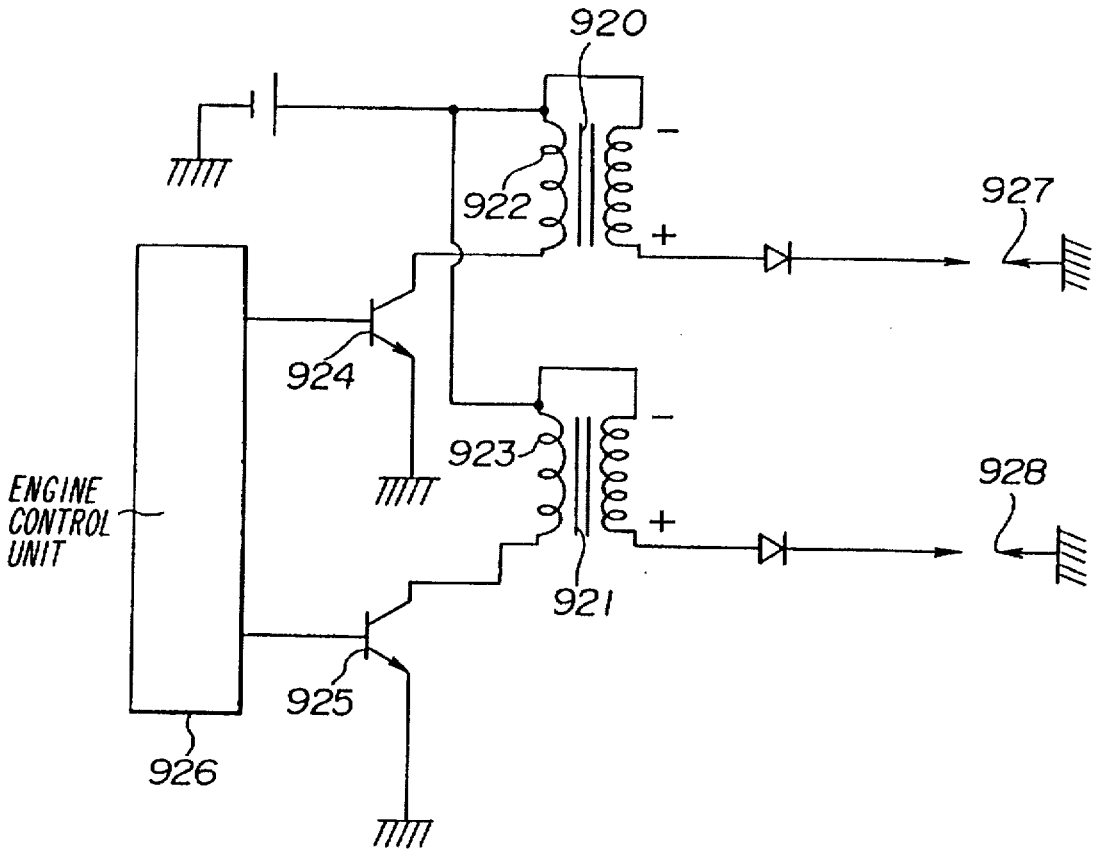
FIG.9 (PRIOR ART)
FIG. 9 is a circuit diagram of a prior art single-ended distributorless ignition system.

That is, FIG. 8 shows a double-ended distributorless ignition system which differs from the ignition system "B" of FIG. 6 in that the discharge circuits 7 composed of the semiconductor devices 71 and the resistors 72 are replaced by resistors "R" for discharge which are connected in parallel to the capacitor voltage dividing circuits 6. By this, the charge accumulated in the connecting lines 55 can be discharged continuously by way of the resistors "R", so the same effect as the embodiment of FIG. 6 can be obtained.

In this case, in order that the misfire detecting circuit 8 can detect a misfire on the basis of the decay characteristic of the divided voltage 60 obtained by the capacitor voltage dividing circuits 6, it is required that the resistance of the resistors "R" be set sufficiently larger (e.g., 10 MΩ~100 MΩ) than the resistance which is caused across the discharge electrodes (center electrode-outer electrode) of the spark plugs 14 or 15 after normal combustion occurs in response to application of a high voltage for ignition.

Further, in the case where the resistance of the resistor R is too large, the desired purpose for discharging the accumulated charge cannot be achieved sufficiently. That is, in the case of continuous misfires, it is necessary that the voltage at the divided voltage 60 output portion of the capacitor divided voltage circuit 6 remains sagged. To this end, it is necessary that the discharge time constant which is the product of the electrostatic capacity of the capacitor 61 on the connecting line 55 side of the capacitor voltage dividing circuit 6 and the resistance of the resistor R is smaller than the discharge time constant which is the product of the electrostatic capacity of the capacitor 62 on the grounded side of the capacitor voltage dividing circuit 6 and the resistance of the resistor 63 connected in parallel to the capacitor 62.

Accordingly, the upper limit of the resistance of each resistors R is set so as to satisfy the above condition. Specifically, for example in the case where the electrostatic capacity on the connecting line 55 side of the capacitor divided voltage circuit 6 is set to 50 pF and the electrostatic capacity of the capacitor 62 on the grounded side is set to 10000 pF so that the capacitor divided voltage ratio of the capacitor voltage dividing circuit 6 is set to 1/200, it will do to set the resistance of the resistor R to 10 MΩ and the discharge time constant by the resistor R to about 0.5 msec. However, in this instance, it will do to use resistors of about 10 MΩ for the resistors 63 connected in parallel to the capacitors 62 on the grounded side.

In this manner, in the case where the discharge means is constituted by utilizing a resistor R connected in parallel to the capacitor voltage dividing circuit 6, a usual resistor can be used for the resistor since assuming that the high voltage pulse is 1 kV and the resistance of the resistor R is 10 KΩ, the power applied to the resistor R is about 0.1 W, so it is not necessary to utilize an expensive semiconductor device such as a transistor, MOS-FET, thyristor and further a control for controlling the discharge timing at which the semiconductor device is turned on for discharge, thus making it possible to obtain the discharge means at a low cost and with a quite simple structure.

In the meantime, it is a matter of course that the structure of utilizing such a resistor R for the discharge means can be applied to, other than the double-ended distributorless ignition system "B" shown in FIG. 8, a single-ended distributorless ignition system "A" shown in FIG. 1, and the distributor type ignition system "C" shown in FIG. 7 to produce the same effects.

What is claimed is:

1. A method of detecting a misfire of an ignition system for making primary current flow intermittently through a primary winding of an ignition coil for thereby producing a high voltage for ignition in a secondary winding, and supplying the high voltage for ignition produced in the secondary winding to spark plugs provided to respective cylinders of a multi-cylinder internal combustion engine, comprising the steps of:

applying a high voltage pulse which is not so high as cause spark discharge, to the secondary winding side by way of a diode during the time after completion of spark discharge and before generation of a high voltage for next ignition;

detecting a misfire at each cylinder on the basis of a decay characteristic of a voltage at a cathode side of the diode; and discharging a charge accumulated at the secondary winding side of said ignition coil before a next high voltage pulse is supplied to said secondary winding side.

2. A misfire detecting device for a single-ended distributorless ignition system having ignition coils of the same number as cylinders of an engine and each having a primary winding and a secondary winding independent from the primary winding, primary current supplying means for supplying battery current to the primary windings of the ignition coils intermittently and in turn, and spark plugs provided to the respective cylinders of the engine and each connected at a center electrode side to one end of the secondary winding and at an outer electrode side to a cylinder side for grounding, the misfire detecting device comprising:

pulse generating means for generating a high voltage pulse which is not so high as to cause spark discharge during the time after completion of spark discharge of one of the spark plugs and before application of a high voltage for ignition to another of the spark plugs which is to discharge next;

reverse current preventing diodes each for applying said high voltage pulse to another end of the secondary winding;

voltage dividing means for dividing a voltage at said other end of the secondary winding to obtain a divided voltage thereat;

detecting means for detecting a misfire on the basis of a decay characteristic of said divided voltage after application of said high voltage pulse; and discharge means for discharging a charge accumulated in the secondary winding of each of the ignition coils before said pulse generating means generates a next high voltage pulse.

3. The misfire detecting device according to claim 2, wherein said discharge means comprises a semiconductor device selected from the group consisting of a transistor, MOS-FET and thyristor.

4. The misfire detecting device according to claim 2, wherein said pulse generating means comprises a boosting coil unit having a primary coil and a secondary coil having more turns than said primary coil, and a semiconductor switching device for making current flow intermittently through said primary coil in response to a control pulse signal supplied thereto, said control pulse signal being also supplied to said semiconductor device so that when said control pulse signal is in a high level condition said semiconductor device conducts to forcedly discharge said charge accumulated in said secondary winding and when said control pulse signal is changed from a high level condition to a low level condition said high voltage pulse is generated in said secondary coil of said boosting coil unit.

5. The misfire detecting device according to claim 2, wherein said discharge means is connected in parallel to said voltage dividing means and comprises a resistor having a resistance which is larger than a resistance caused across electrodes of each of said spark plugs after normal combustion, said charge accumulated in said secondary winding being discharged through said resistor with a predetermined time constant.

6. A misfire detecting device for a double-ended distributorless ignition system having a plurality of ignition coils for simultaneous spark, primary current supplying means for supplying battery current to primary windings of the ignition coils intermittently and in turn, and positive ignition spark plugs connected at center electrodes to positive pole sides of respective secondary windings of the ignition coils and grounded at outer electrodes, negative ignition spark plugs connected at center electrodes to negative pole sides of the respective secondary windings and grounded at outer electrodes, the misfire detecting device comprising:

pulse generating means for generating a positive polarity pulse which is not so high as to cause spark discharge, during the time after completion of spark discharge of one of the spark plugs and before application of a high voltage for ignition to another of the spark plugs which is to discharge next;

first diodes connected at anodes to an output end of said pulse generating means;

second diodes connected at anodes to the cathodes of said respective first diodes and at cathodes to positive pole sides of the respective secondary windings;

voltage dividing means for dividing voltages at connecting lines connecting between the cathodes of said first diodes and the anodes of said second diodes to obtain divided voltages thereat;

detecting means for detecting a misfire on the basis of decay characteristics of said divided voltages after application of said high voltage pulse; and discharge means for discharging a charge accumulated in each of said connecting lines before said pulse generating means generates a next high voltage pulse.

7. The misfire detecting device according to claim 6, wherein said discharge means comprises a semiconductor device selected from the group consisting of a transistor, MOS-FET and thyristor.

8. The misfire detecting device according to claim 6, wherein said pulse generating means comprises a boosting coil unit having a primary coil and a secondary coil having more turns than said primary coil, and a semiconductor switching device for making current flow intermittently through said primary coil in response to a control pulse signal supplied thereto, said control signal being also supplied to said semiconductor device so that when said control pulse signal is in a high level condition said semiconductor device conducts to carry out forced discharge and when said control pulse signal is changed from a high level condition to a low level condition said high voltage pulse is generated in said secondary coil of said boosting coil unit.

9. The misfire detecting device according to claim 6, wherein said discharge means is connected in parallel to said voltage dividing means and comprises a resistor having a resistance which is larger than a resistance caused across said electrodes of each of said spark plugs after normal combustion, said charge accumulated in each of said connecting lines being discharged through said resistor with a predetermined time constant.

10. A misfire detecting device for an ignition having an ignition coil having a primary winding and a secondary winding, primary current supplying means for intermittently supplying battery current to the primary winding of the ignition coil, a distributor connected at a rotor side to one end of the secondary winding, and a spark plug for each cylinder, connected at a center electrode to a side electrode of the distributor by way of a high tension code and grounded at an outer electrode side to a cylinder side, the misfire detecting device comprising:

pulse generating means for generating a high voltage pulse which is not so high as to cause spark discharge just after completion of spark discharge of said spark plug;

a first diode connected at an anode to an output end of said pulse generating means;

a second diode connected at an anode to a cathode of said first diode and at a cathode to said high tension code;

voltage dividing means for dividing a voltage at a connecting line connecting between said cathode of said first diode and said anode of said second diode to obtain a divided voltage thereat;

detecting means for detecting a misfire on the basis of a decay characteristic of said divided voltage after application of said high voltage pulse; and discharge means for discharging a charge accumulated in said connecting line before said pulse generating means generates a next high voltage pulse.

11. The misfire detecting device according to claim 10, wherein said discharge means comprises a semiconductor device selected from the group consisting of a transistor, MOS-FET and thyristor.

12. The misfire detecting device according to claim 10, wherein said pulse generating means comprises a boosting coil unit having a primary coil and a secondary coil having more turns than said primary coil, and a semiconductor switching device for making current flow intermittently through said primary coil in response to a control pulse signal supplied thereto, said control signal being also supplied to said semiconductor device so that when said control pulse signal is in a high level condition said semiconductor device conducts to carry out forced discharge and when said control pulse signal is changed from a high level condition to a low level condition said high voltage pulse is generated in said secondary coil of said boosting coil unit.

13. The misfire detecting device according to claim 10, wherein said discharge means is connected in parallel to said voltage dividing means and comprises a resistor having a resistance which is larger than a resistance caused across electrodes of the spark plug after normal combustion, said charge accumulated in said connecting line being discharged through said resistor with a predetermined time constant.

* * * * *